US006443781B2

(12) United States Patent
Kubo

(10) Patent No.: US 6,443,781 B2
(45) Date of Patent: Sep. 3, 2002

(54) CONNECTOR

(75) Inventor: Akinobu Kubo, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/726,435

(22) Filed: Dec. 1, 2000

(30) Foreign Application Priority Data

Dec. 2, 1999 (JP) ..... 11-343870

(51) Int. Cl.[7] ..... H01R 13/436
(52) U.S. Cl. ..... 439/752
(58) Field of Search ..... 439/752, 746–748, 439/595

(56) References Cited

U.S. PATENT DOCUMENTS 3,581,271 A * 5/1971 Knitter et al. ..... 439/748
5,820,421 A * 10/1998 Makino ..... 439/752
6,050,860 A * 4/2000 Tsuchiya ..... 439/748
6,086,431 A * 7/2000 Konoya et al. ..... 439/752

FOREIGN PATENT DOCUMENTS

JP 63-257187 10/1998

* cited by examiner

*Primary Examiner*—Hien Vu
(74) *Attorney, Agent, or Firm*—Banner & Witcoff, Ltd.

(57) ABSTRACT

The present invention provides a connector wherein a terminal fitting provided with a metal lance is retained by a retainer. A cavity 21 is formed within a housing 20 and is capable of housing a terminal fitting 10 provided with a metal lance 15. A retainer attachment hole 22 opens into the cavity 21 and allows the attachment of a retainer 30 which engages with the terminal fitting 10. This retainer attachment hole 22 opens into a lower face of the housing 20. A stopping wall 24 which retains the metal lance 15 is formed immediately to the anterior of the retainer attachment hole 22 and, to its anterior, a jig insertion hole 26 opens in an anterior direction. A jig 50 for bending the metal lance 15 can be inserted into the cavity 21 from this jig insertion hole 26. The stopping wall 24 is provided with a through hole 40 through which the jig 50 passes to reach the retainer attachment hole 22 provided to the posterior side of the stopping wall 24. A joining hole 41, which connects to the through hole 40, is formed in a fitting member 34 of the retainer 30, and the jig 50 passes through this joining hole 41.

2 Claims, 5 Drawing Sheets

CONNECTOR

TECHNICAL FIELD

The present invention relates to an electrical connector which houses terminal fittings provided with metal lances.

BACKGROUND TO THE INVENTION

Conventionally, connectors used metal lances to retain terminal fittings. As shown in FIG. 12 of this specification, this type of connector has a configuration whereby a metal lance 2 is cut out from a side wall of a terminal fitting 1, and a step 4 is formed on a side face of a cavity 3 of a housing 5. The metal lance 2 bends while the terminal fitting 1 is being inserted into the cavity 3. After the terminal fitting 1 has been pushed in to a specified position, the metal lance 2 returns to its original position and engages with the step 4, thereby preventing the removal of the terminal fitting 1.

A connector with this type of configuration is described in JP-63-257187.

The configuration using metal lances, whereby the lances serve to retain the terminal fitting against the side wall of the cavity, generally has a much greater retaining force than when plastic lances are used. Consequently, double retaining, using a retainer or the like, is not necessary. However, terminal fittings have been miniaturised in recent years, and consequently the metal lances have also become smaller. As a result, there is the danger that the retaining force of the metal lances alone may be insufficient, and it has been proposed that connectors which use metal lances should also be doubly retained by retainers.

In response to this, it was proposed that a retainer attachment hole 6 (shown by the chain line in FIG. 12) be formed in a side face of the housing 5, this retainer attachment hole 6 opening into the cavity 3. A retainer provided with a fitting member is inserted from the side into the retainer attachment hole 6. After the terminal fitting 1 has been inserted into the cavity 3 and is retained therein by the metal lance 2, the retainer is pushed further inwards, and the fitting member engages with a cog member 7 of the terminal fitting 1, thereby doubly retaining the terminal fitting 1. In the configuration described above, the means of doubly retaining the terminal fitting 1 is effective. However, problems arise when the terminal fitting 1 is to be removed from the cavity 3 for maintenance or the like. That is, when the terminal fitting 1 is to be removed, the retainer is pushed back, a jig is inserted from the anterior of the stopping stepped member 4, the metal lance 2 is bent, thereby releasing its engagement, and the terminal fitting 1 is pulled out. However, as has been explained, the retainer attachment hole 6 opens into the side wall of the cavity 3 through which the metal lance 2 passes. Consequently, there is the problem that the metal lance 2 returns to its original position at the time it passes the retainer attachment hole 6, and it catches with a hole edge thereof. As a result, the terminal fitting 1 cannot be easily removed.

The present invention has taken the above problem into consideration, and aims to present a connector wherein a terminal fitting is retained by a metal lance, and is doubly retained by a retainer.

According to the invention there is provided an electrical connector comprising a housing, a cavity in the housing and an electrical terminal insertable from a posterior side into said cavity, the terminal having a resilient lance part-sheared therefrom and engageable with a step of said cavity in order to retain the terminal from movement to the posterior side, and the housing having a jig insertion hole extending in the direction of said cavity and adapted to receive a jig for bending said lance to release engagement thereof with said step, and said housing further including an aperture opening into said cavity at the posterior side of said step, and a retainer insertable into said aperture and engageable with an abutment of said terminal to doubly retain said terminal from movement to said posterior side, characterized in that a recess is provided in said step and aligned with said jig insertion hole, said recess opening into said aperture whereby a jig may be inserted through said jig insertion hole, and said recess to the posterior side of said aperture, to bend said lance to release engagement thereof with said housing. Such an invention permits easy removal of a terminal using a single insertion jig.

Preferably the retainer is movable from a temporarily latched condition permitting free insertion of the terminal, and a fully latched condition in which the abutment of the terminal is engaged. In this arrangement the retainer preferably includes an aperture or slot to receive the release jig in the temporarily latched condition, thus reducing stroke of the retainer between the temporarily and fully latched conditions.

BRIEF DESCRIPTION OF DRAWINGS

Other features of the invention will be apparent from the following description of a preferred embodiment of the invention shown by way of example in the accompanying drawings in which.

DESCRIPTION OF PREFERRED EMBODIMENT

An embodiment of the present invention is described below with the aid of FIGS. 1 to 11. This embodiment shows a female connector which houses a terminal fitting provided with a metal lance.

Figure 2:
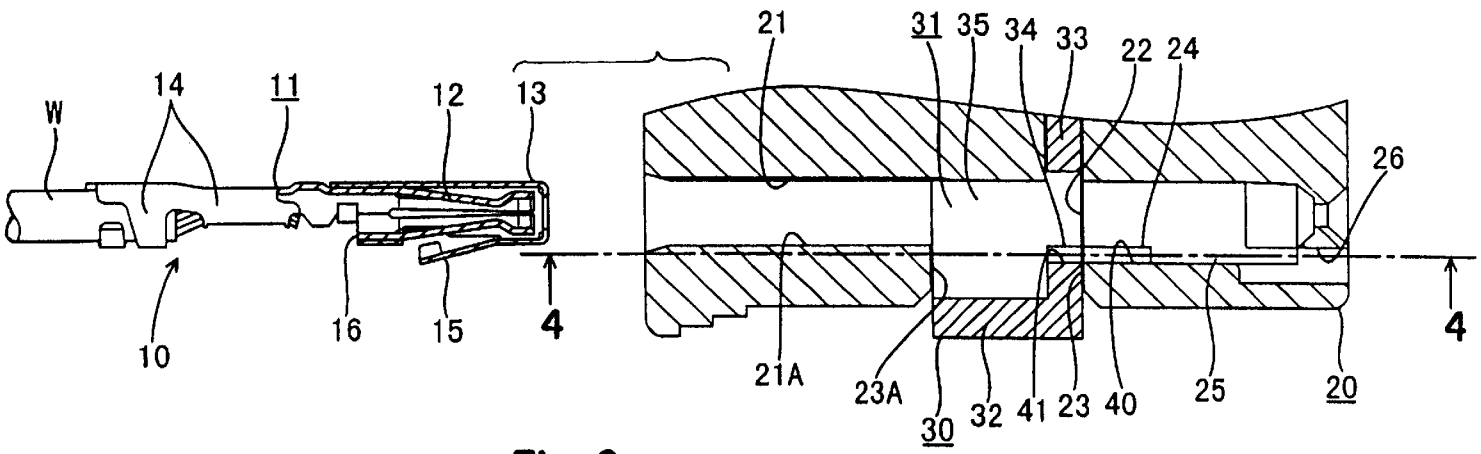
FIG. 2 is a cross-sectional view along the line 2—2 of FIG. 1 showing the housing and a terminal fitting.

The terminal fitting 10 will be described first. As shown in FIG. 2, the terminal fitting 10 is formed from a terminal main body 11 provided with a connecting member 12 which connects with a corresponding male terminal fitting, and a cylindrical cover 13 which is attached so as to surround the connecting member 12. A barrel member 14 is formed to the posterior of the connecting member 12 of the terminal main body 11. This barrel member 14 is attached by crimping to an electric wire W. A cantilevered metal lance 15 is cut out from a lower face (relative to FIG. 2) of the cover 13. The metal lance 15 has its base end at its anterior side, and is capable of bending inwards. A posterior end of the connecting member 12 of the terminal main body 11 and a posterior end of the cover 13 join at a lower face side of the terminal fitting 10 to form an abutment or cog member 16 capable of fitting with a retainer 30.

Figure 1:
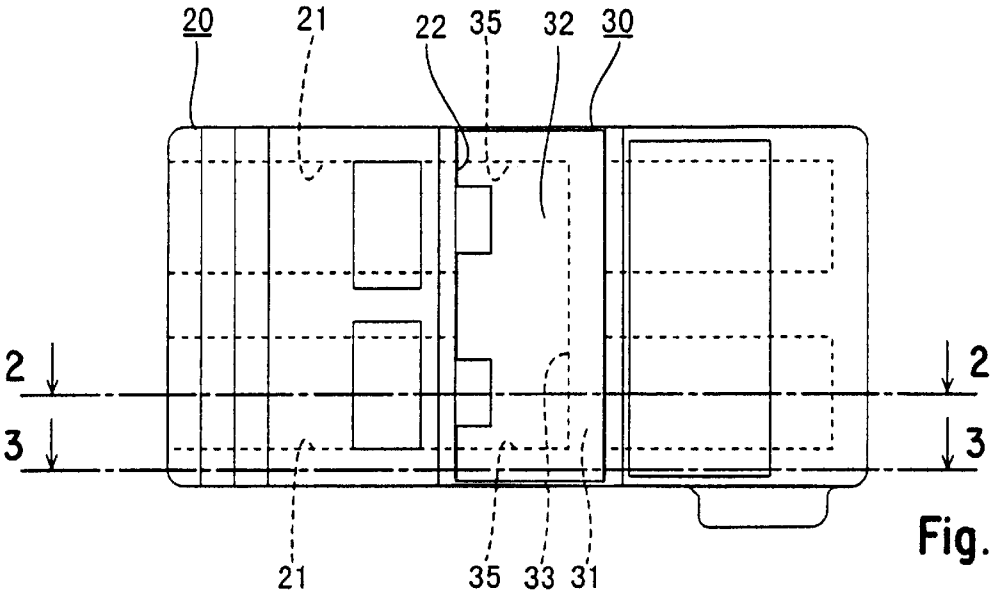
FIG. 1 is a base face view of a housing of an embodiment of the present invention.

Next, a connector housing 20 (hereafter referred to simply as housing 20) will be described. As shown in FIGS. 1 and 2, the housing 20 has two cavities 21 aligned therein in a width-wise direction. The terminal fittings 10 are inserted from the posterior into these cavities 21. A plurality of upper and lower steps are provided within the cavities 21. Only the lowermost step will be described below. An aperture or retainer attachment hole 22, to which the retainer 30 can be attached, is formed in the housing 20 at an approximately central location relative to the length-wise direction of the cavity 21. This retainer attachment hole 22 intersects with the cavity 21 in an up-down direction relative to FIG. 2. The retainer attachment hole 22 forms an opening 23 of a specified length in a lower face of the housing 20.

Figure 5:
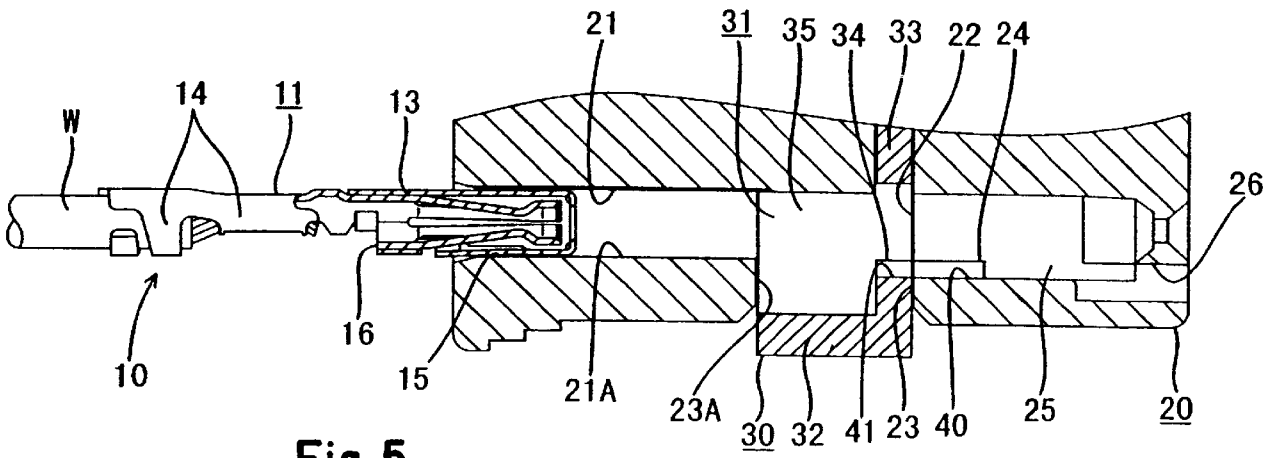
FIG. 5 is a cross-sectional view along the line 2—2 of FIG. 1 showing the terminal fitting being inserted into a cavity.

As shown in FIG. 5, when the terminal fitting 10 is inserted into the cavity, the metal lance 15 thereof makes contact with a base face 21A of the cavity 21 and bends. When the metal lance 15 passes the opening 23 of the retainer attachment hole 22 it returns to its original position, and then it is again bent by a step or stopping wall 24 provided at an anterior side of the retainer attachment hole 22. When the metal lance 15 reaches a bending space 25 at the anterior of the stopping wall 24, it again returns to its original position, and is retained by the stopping wall 24 (see FIG. 6). The depth to which the terminal fitting 10 has been inserted when the metal lance 15 is retained by the stopping wall 24 is the correct inserting position of the terminal fitting 10. An opening is formed in an anterior end portion of the housing 20 at a location to the anterior of the bending space 25, this forming a jig insertion hole 26 into which a jig 50 is inserted to bend the metal lance 15.

Figure 3:
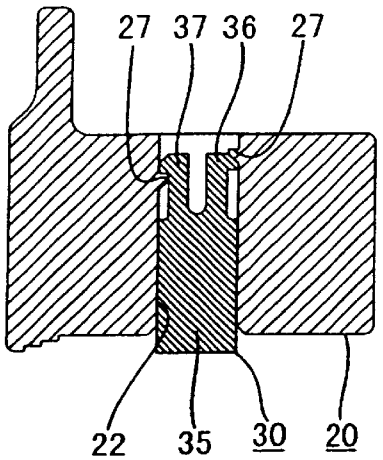
FIG. 3 is a cross-sectional view along the line 3—3 of FIG. 1 showing the housing prior to the terminal fitting being inserted.

The retainer attachment hole 22 (both side edges of the opening 23 thereof are shown in FIG. 1) passes through to an upper face of the housing 20 (as shown in FIG. 3). Protrusions 27 are formed in side grooves of the retainer attachment hole 22, on mutually opposing anterior and posterior walls. The anterior protrusion 27 is formed at a higher location, relative to FIG. 3, and the posterior protrusion 27 is formed at a lower location. Side plates 35 of the retainer 30 are inserted into these side grooves, and stopping claws 36 and 37 of the side plates 35 catch with these two protrusions, thereby maintaining the position of the retainer 30 in both up and down directions. The side grooves are formed by cutting away side walls of exterior sides of the cavity 21.

As shown in FIGS. 1 and 2, the retainer 30 is approximately C-shaped and is provided with a main body 31 which, as shown in FIG. 2, is inserted upwards into the opening 23 of the retainer attachment hole 22. A base plate 32 which fits with the opening 23 of the retainer attachment hole 22 is formed at a lower end of the main body 31.

The main body 31 is provided with anterior plates 33 which extend along the width-wise direction of the housing 20 and are provided directly to the posterior of the stopping wall 24 within the retainer attachment hole 22. Holes provided in these anterior plates 33 join with the cavity 21, the terminal fitting 10 being capable of passing through these holes. A fitting member 34 which fits with the cog member 16 of the terminal fitting 10 is provided below the holes.

As shown in FIG. 3, the side plates 35 provided on both side edges of the pair of anterior plates 33 of the main body 31 are inserted into the grooves at the sides of the retainer attachment hole 22. The main stopping claw 36 and the temporary stopping claw 37 are provided to the anterior and the posterior respectively on upper edges of the side plates 35. These stopping claws 36 and 37 fit with the protrusions 27 of the housing 20.

As shown in FIG. 3, when the posteriorly located temporary stopping claw 37 fits with the protrusion 27, the base plate 32 of the retainer 30 protrudes from the lower face of the housing 20. At this juncture, as shown in FIG. 2, an upper face of the fitting member 34 is positioned so as to form an approximately unified face with an upper face of the stopping wall 24 which is located to its anterior. This allows the terminal fitting 10 to be inserted into the cavity 21, and the metal lance 15 engages with these upper faces as this insertion progresses, thereby causing the metal lance 15 to bend. At this juncture, the retainer 30 is in a temporary retaining position.

Figure 7:
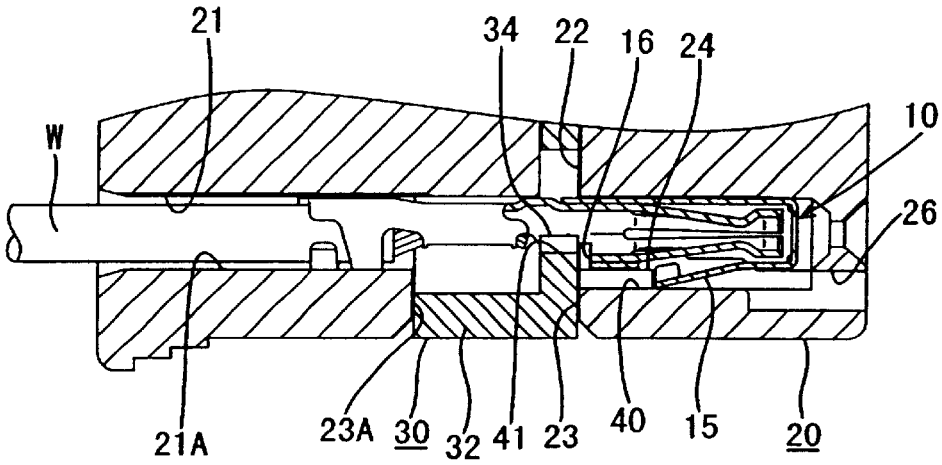
FIG. 7 is a cross-sectional view along the line 2—2 of FIG. 1 showing the terminal fitting doubly retained by a retainer.
Figure 8:
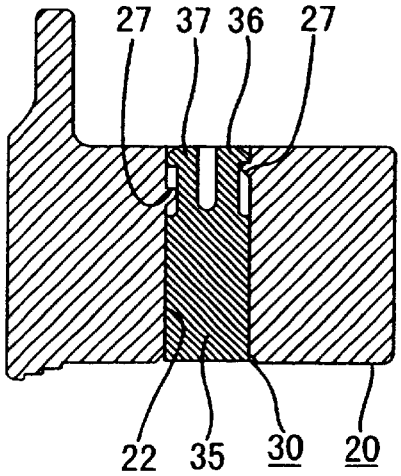
FIG. 8 is a cross-sectional view along the line 3—3 of FIG. 1 showing the retainer in a state whereby it has been moved to a main retaining position.

As shown in FIG. 8, after the anteriorly located main stopping claw 36 has risen over the protrusion 27, it fits therewith, and the lower face of the base plate 32 of the retainer 30 forms an approximately unified face with the lower face of the housing 20. At this juncture, as shown in FIG. 7, the fitting member 34 enters upwards into the cavity 21 and fits immediately to the posterior of the cog member 16 of the terminal fitting 10. Now the retainer 30 is in the main retaining position.

Figure 4:
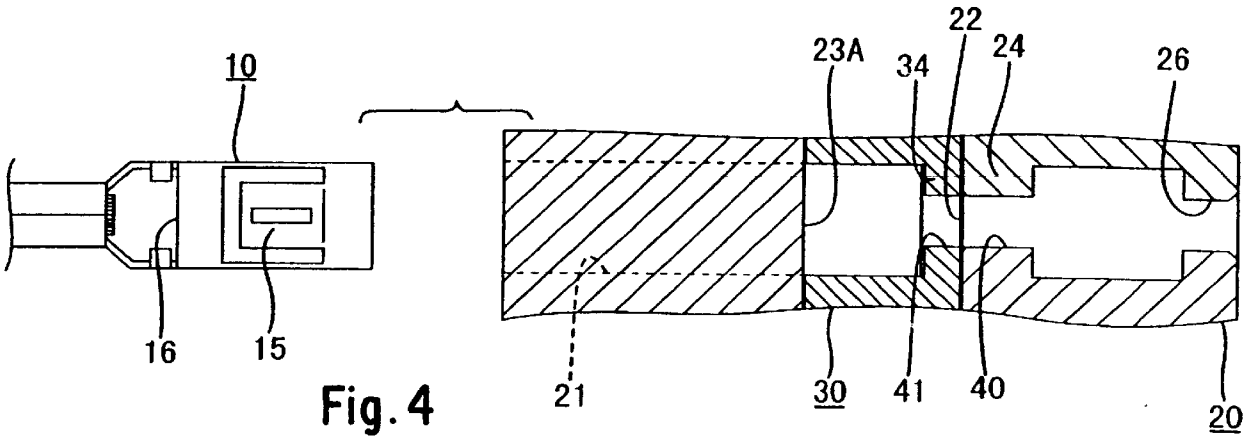
FIG. 4 is a cross-sectional view along the line 4—4 of FIG. 2 showing the housing prior to the terminal fitting being inserted.

As shown in FIG. 4, a through hole 40 is provided in the stopping wall 24 of the housing 20, at a central location in a width-wise direction thereof. The jig 50 which has passed via the jig insertion hole 26 into the cavity 21 passes through this through hole 40. The through hole 40 passes through the stopping wall 24 from the anterior to the posterior thereof. The dimensions of the through hole 40 correspond to the width of the jig 50, and the jig 50 is inserted therethrough into the retainer insertion hole 22 at the posterior of the stopping wall 24.

Figure 10:
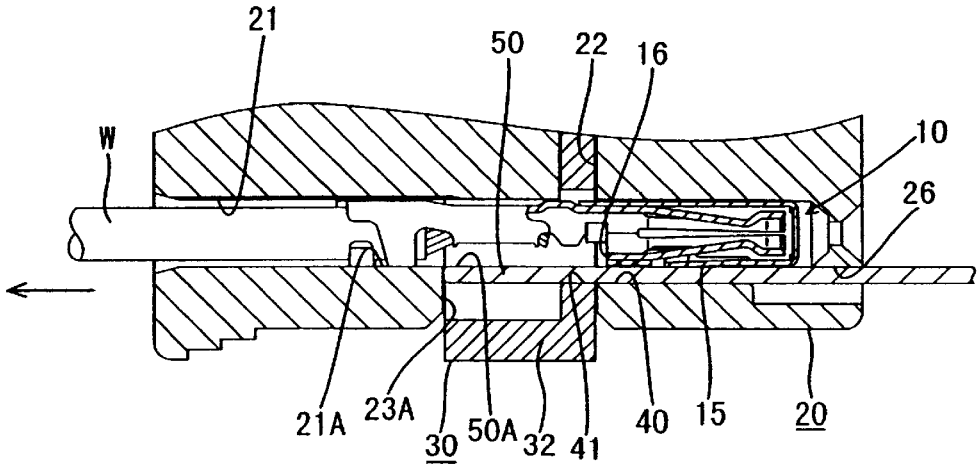
FIG. 10 is a cross-sectional view along the line 2—2 of FIG. 1 showing the jig which has made contact with a posterior end face of an opening of a retainer attachment hole.

A joining hole 41 is provided in the fitting member 34 of the retainer 30, at a central portion in a width-wise direction thereof. This joining hole 41 joins with the through hole 40 of the stopping wall 24 which is located at its anterior side. The joining hole 41 has approximately the same dimensions as the through hole 40, and passes through the fitting member 34 from the anterior to the posterior thereof. The jig 50 passes through the joining hole 41 from the through hole 40. As shown in FIG. 10, the jig 50, which has passed through the joining hole 41, is inserted to a depth whereby it makes contact with a posterior end face 23A of the opening 23 of the retainer attachment hole 22. An upper face 50A of the jig 50 forms an approximately unified face with the base face 21A of the cavity 21. When the jig 50 is in a state whereby it makes contact with the posterior end face 23A of the opening 23, the upper face 50A of the jig 50 and the base face 21A of the cavity 21 form a flat face along the entirety of the base face side of the cavity 21.

Figure 6:
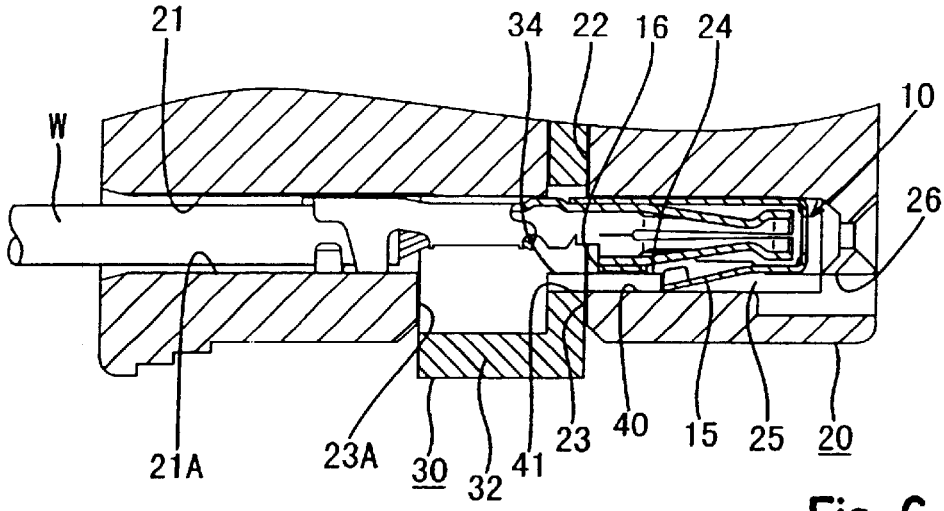
FIG. 6 is a cross-sectional view along the line 2—2 of FIG. 1 showing the terminal fitting in a state where it has been pushed in to a correct inserting position.

The present embodiment is configured as described above. Next, the operation thereof will be described. As shown in FIG. 1, after the retainer 30 has been attached to the housing 20 in the temporary retaining position, the terminal fitting 10 is inserted into the cavity 21. As shown in FIG. 6, pushing the terminal fitting 10 in to the correct inserting position causes the metal lance 15 to be retained by the stopping wall 24. The terminal fitting 10 is then in a first retained state.

Next, as shown in FIG. 7, the retainer 30, which is in the temporary retaining position, is pushed upwards into the main retaining position. The fitting member 34, which moves upwards as the retainer 30 moves, fits directly to the posterior of the cog member 16 of the terminal fitting 10. By this means, the terminal fitting 10 is in a doubly retained state. That is, it is doubly retained within the housing 20.

Figure 9:
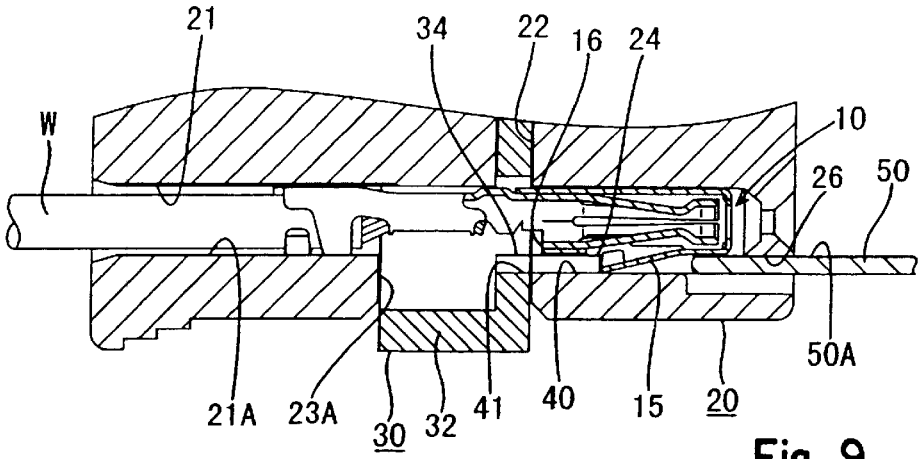
FIG. 9 is a cross-sectional view along the line 2—2 showing a jig being inserted.

The terminal fitting 10 may need to be removed from the housing 20 for maintenance or the like. In such a situation, the retainer 30 is moved to the temporary retaining position and the doubly retained state provided by the fitting member 34 is released. Then, as shown in FIG. 9, the jig 50 is inserted via the jig insertion hole 26 at the anterior end face of the housing 20. The jig 50 is inserted from the anterior and makes contact with the metal lance 15 which is retained by the stopping wall 24. The metal lance 15 is thereby bent inwards, and is released from its retained state with the stopping wall 24.

Next, the jig 50 is pushed further inwards. After the jig 50 has passed through the through hole 40 provided in the stopping wall 24, it passes through the joining hole 41 which is provided immediately to the posterior of the through hole 40, and which is provided in the fitting member 34 of the retainer 30. The jig 50, which has passed through the joining hole 41, is inserted into the retainer attachment hole 22 and makes contact with the posterior end face 23A of the opening 23 of this retainer attachment hole 22. As shown in FIG. 10, the insertion operation of the jig 50 is now complete. Then the electric wire W is pulled, and the terminal fitting 10 is thereby removed from the cavity 21.

Figure 11:
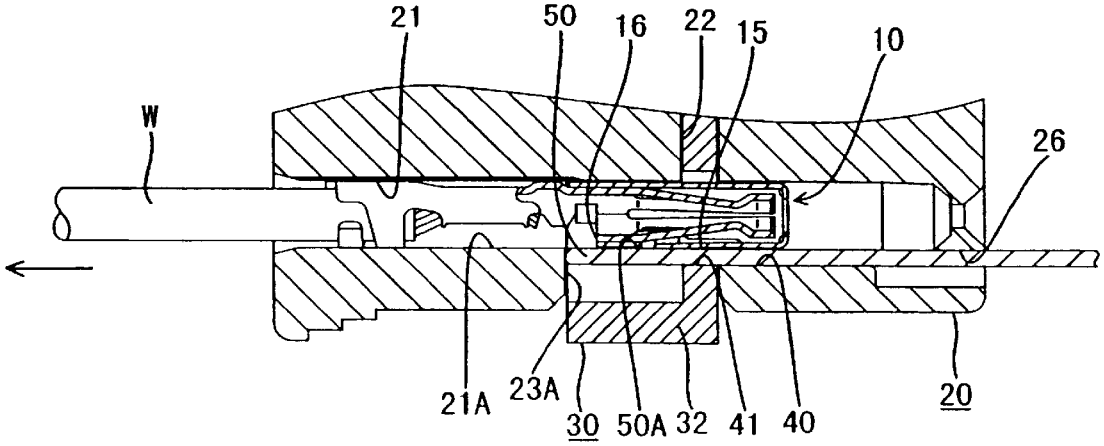
FIG. 11 is a cross-sectional view along the line 2—2 of FIG. 1 showing the terminal fitting being removed.
Figure 12:
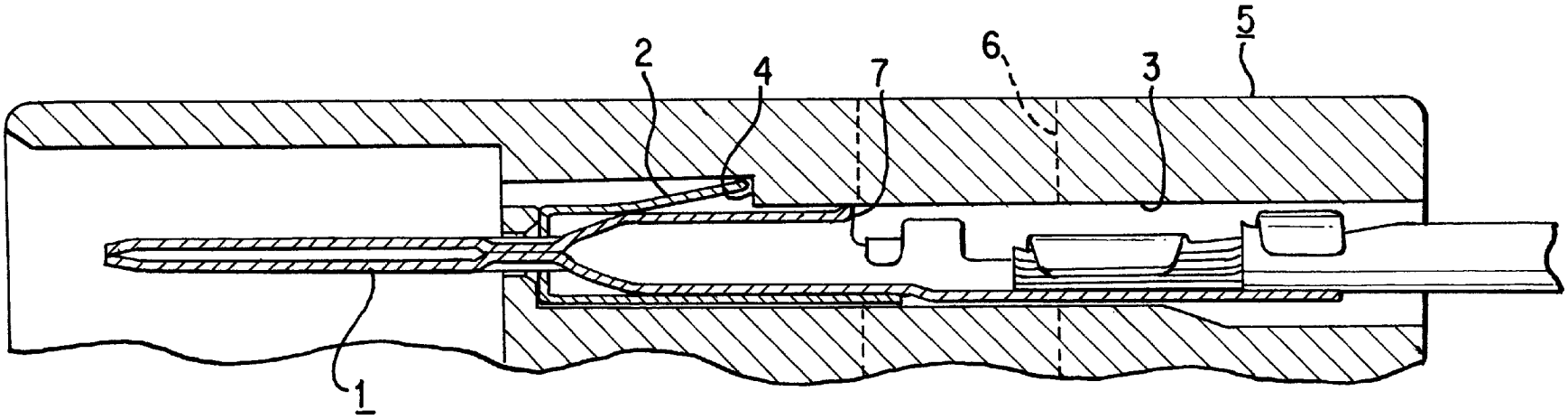
Fig. 12 PRIOR ART
FIG. 12 is a cross-sectional view of a prior art example.

As shown in FIG. 11, the terminal fitting 10 is removed while the metal lance 15 is kept bent by the jig 50. After a posterior end of the metal lance 15 has passed the posterior end face 23 of the retainer attachment hole 22, the terminal fitting 10 is removed while the metal lance 15 is kept bent by the base face 21A of the cavity 21.

That is, the base face 21A of the cavity 21 and the upper face 50A of the jig 50 form a joining flat face which extends without any steps along the entirety of the base face side of the cavity 21. Consequently, as the terminal fitting 10 is being removed, the metal lance 15 thereof remains in a bent state until it is removed from the cavity 21. As a result, the lance 15 does not catch with anything during its removal from the cavity 21, and the terminal fitting 10 is removed smoothly. Moreover, the jig 50 is inserted in one single operation, thus improving operability.

Furthermore, the retainer 30 is provided with the joining hole 41 which connects to the through hole 40 of the stopping wall 24. Consequently, when the retainer 30 is in the temporary retaining position, the fitting member 34 thereof is provided in a location which has a similar height to the terminal fitting 10 and, as a result, the stroke between the temporary retaining position and the main retaining position of the retainer 30 is decreased by the height of this joining hole 41. Consequently, the operability of the retainer 30 improves.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the tip of the jig makes contact with the hole edge at the posterior of the retainer attachment hole. However, a groove may equally well be provided to the posterior of the retainer attachment hole, and the jig inserted more deeply therein. In that case, the inserting position of the jig would be stabilized due to the jig fitting with this groove. Moreover, the groove could pass through to a posterior edge of the housing.

(2) In the embodiment described above, the joining hole is provided in the fitting member of the retainer. However, according to the present invention, if the fitting member of the retainer is at a location distant from the location of the through hole of the stopping wall at the time when the retainer is in the temporary retaining position, no joining hole need be provided.

(3) The present invention is not limited to a female connector. It is also suitable for a male connector.

What is claimed is:

1. An electrical connector comprising:

a housing having a posterior side and an anterior side;

a cavity in the housing, the cavity having a step and the step having a recess opening into the cavity;

an electrical terminal insertable into the cavity from the posterior side of the housing, the terminal being part-sheared to define a resilient lance that is engageable with the step when fully inserted in the cavity to retain the terminal and prevent removal of the terminal from the posterior side, the terminal further including an abutment;

an aperture in the housing that opens into the cavity posterior to the step, the recess opening into the aperture;

a retainer insertable in the aperture and engageable with the abutment of the terminal to doubly retain the terminal and thereby prevent removal of the terminal from the cavity from the posterior side; and a jig insertion hole in the housing extending in the direction of the cavity to receive a jig for bending the lance so as to release the lance from engagement with the step, the jig insertion hole extending through the step and into the recess so that the jig is extendible through the aperture to prevent engagement of the lance with sides of the aperture during removal of the terminal from the cavity;

wherein the retainer is movable from a temporary condition permitting the terminal to pass freely into the cavity to a final condition in which the retainer and abutment are engaged, the retainer having a channel adapted to receive a jig and aligned with the recess when the retainer is in the temporary condition.

2. The connector of claim 1, wherein the recess is a slot.

* * * * *

UNITED STATES PATENT AND TRADEMARK OFFICE

CERTIFICATE OF CORRECTION

PATENT NO. : 6,443,781 B2
DATED : September 3, 2002
INVENTOR(S) : Akinobu Kubo

It is certified that error appears in the above-identified patent and that said Letters Patent is hereby corrected as shown below:

Column 6,
Line 63, insert -- electrical -- before “connector”.

Signed and Sealed this

Seventh Day of January, 2003

JAMES E. ROGAN
*Director of the United States Patent and Trademark Office*